US009121657B2

(12) United States Patent
Beckmann et al.

(10) Patent No.: US 9,121,657 B2
(45) Date of Patent: Sep. 1, 2015

(54) MANOEUVRES CARTRIDGE DEVICE AND SELF-LOADING FIREARM SUITABLE THEREFOR

(75) Inventors: Rudi Beckmann, Aichhalden-Roetenberg (DE); Rolf Hezel, Boesingen (DE)

(73) Assignee: HECKLER & KOCH GMBH, Oberndorf (DE)

( * ) Notice: Subject to any disclaimer, the term of this patent is extended or adjusted under 35 U.S.C. 154(b) by 0 days.

(21) Appl. No.: 14/236,337

(22) PCT Filed: Jul. 2, 2012

(86) PCT No.: PCT/EP2012/062794

§ 371 (c)(1), (2), (4) Date: Jan. 31, 2014

(87) PCT Pub. No.: WO2013/017351

PCT Pub. Date: Feb. 7, 2013

(65) Prior Publication Data

US 2014/0137730 A1 May 22, 2014

(30) Foreign Application Priority Data

Aug. 2, 2011 (DE) ..... 10 2011 080 288

(51) Int. Cl.

| | |
|---|---|
| ***F41A 21/26*** | (2006.01) |
| ***F41A 21/32*** | (2006.01) |
| ***F41A 21/36*** | (2006.01) |
| ***F41A 5/18*** | (2006.01) |

(52) U.S. Cl.

CPC . *F41A 21/32* (2013.01); *F41A 5/18* (2013.01); *F41A 21/26* (2013.01); *F41A 21/36* (2013.01)

(58) Field of Classification Search

CPC ..... F41A 21/00; F41A 21/26; F41A 21/28; F41A 21/32; F41A 21/10; F41A 5/18

USPC ..... 42/96, 106, 76.01, 79, 90, 78, 77; 89/14.5, 29

See application file for complete search history.

(56) References Cited

U.S. PATENT DOCUMENTS

| | | | | |
|---|---|---|---|---|
| 1,092,157 | A * | 4/1914 | Mauser | 42/77 |
| 1,290,840 | A * | 1/1919 | Maynard | 42/76.01 |
| 1,671,327 | A | 5/1928 | Studler | |
| 2,330,210 | A * | 9/1943 | Garand | 89/193 |
| 2,805,602 | A * | 9/1957 | Moore | 89/14.5 |
| 3,369,453 | A * | 2/1968 | Menneking et al. | 89/14.5 |
| 3,440,924 | A * | 4/1969 | Robinson | 89/14.5 |

(Continued)

FOREIGN PATENT DOCUMENTS

| | | | | |
|---|---|---|---|---|
| DE | 3733216 A1 * | 4/1989 | | F41D 7/02 |
| DE | 4315829 C2 | 11/1994 | | |

(Continued)

*Primary Examiner* — Jonathan C Weber

(74) *Attorney, Agent, or Firm* — Leydig, Voit & Mayer, Ltd.

(57) ABSTRACT

A maneuver cartridge device for use in a self-loading firearm includes a barrel extending from a chamber to a muzzle side and having an intercepting device arranged on the muzzle side for intercepting a projectile. The barrel has a first barrel section that adjoins the chamber and a second barrel section that adjoins the first barrel section. The first barrel section has a first cross section corresponding to a caliber of the projectile and the second barrel section has a second cross section that is larger than the first cross section.

11 Claims, 4 Drawing Sheets

(56) References Cited

U.S. PATENT DOCUMENTS

| | | | | |
|---|---|---|---|---|
| 3,687,000 | A * | 8/1972 | Csizmar et al. | 89/14.5 |
| 3,744,370 | A * | 7/1973 | Snodgrass | 89/14.5 |
| 3,766,822 | A * | 10/1973 | Sophinos | 89/14.5 |
| 4,104,953 | A * | 8/1978 | Bard et al. | 89/14.5 |
| 5,377,438 | A * | 1/1995 | Sheinfeld et al. | 42/96 |
| 5,463,930 | A | 11/1995 | Bisping et al. | |
| 5,992,291 | A | 11/1999 | Widder et al. | |
| 6,026,728 | A | 2/2000 | Guehring et al. | |
| 6,176,032 | B1 * | 1/2001 | Cohen et al. | 42/96 |
| 6,289,623 | B1 | 9/2001 | Cohen et al. | |
| 6,318,230 | B1 * | 11/2001 | Bamber | 89/14.5 |
| 6,889,593 | B2 * | 5/2005 | Guhring et al. | 89/14.5 |
| 6,973,863 | B1 | 12/2005 | Jones | |
| 7,658,138 | B2 * | 2/2010 | Wossner et al. | 89/29 |
| 7,870,815 | B2 | 1/2011 | Hung | |
| 7,942,090 | B1 * | 5/2011 | Hoffman | 89/29 |
| 8,156,855 | B2 * | 4/2012 | Anderson | 89/14.05 |
| 8,201,487 | B2 * | 6/2012 | Dueck et al. | 89/14.05 |
| 8,677,672 | B2 * | 3/2014 | Kennedy et al. | 42/96 |
| 2005/0028421 | A1 * | 2/2005 | Saxby et al. | 42/77 |
| 2005/0066804 | A1 | 3/2005 | Guhring et al. | |
| 2006/0243125 | A1 * | 11/2006 | La France | 89/31 |
| 2007/0017357 | A1 | 1/2007 | Fluhr | |
| 2010/0281747 | A1 * | 11/2010 | Anderson | 42/90 |
| 2011/0056364 | A1 * | 3/2011 | Kennedy et al. | 89/14.05 |

FOREIGN PATENT DOCUMENTS

| | | | |
|---|---|---|---|
| DE | 19729565 | C2 | 1/1999 |
| DE | 10305644 | B3 | 5/2004 |
| EP | 14090644 | B1 | 12/2004 |
| GB | 2365101 | A | 2/2002 |

* cited by examiner

MANOEUVRES CARTRIDGE DEVICE AND SELF-LOADING FIREARM SUITABLE THEREFOR

CROSS-REFERENCE TO PRIOR APPLICATIONS

This application is a U.S. National Phase Application under 35 U.S.C. §371 of International Application No. PCT/EP2012/062794, filed on Jul. 2, 2012, and claims benefit to German Patent Application No. DE 10 2011 080 288.6, filed on Aug. 2, 2011. The International Application was published in German on Feb. 7, 2013 as WO 2013/017351 under PCT Article 21(2).

FIELD

The invention relates to a maneuver cartridge device for use in a self-loading firearm, comprising a barrel extending from a cartridge chamber to a muzzle and having an intercepting device arranged on the muzzle side for intercepting a projectile.

BACKGROUND

European patent document EP 1 490 644 B1 discloses a maneuver cartridge device. The intercepting device serves to hold projectiles of live ammunition that might be inadvertently fired instead of maneuver cartridges during maneuvers if the safety regulations are not followed and if the safety devices are circumvented.

The intercepting device is normally integrated into the maneuver cartridge apparatus.

SUMMARY

In an embodiment, the present invention provides a maneuver cartridge device for use in a self-loading firearm. A barrel extends from a cartridge chamber to a muzzle side and has an intercepting device arranged on the muzzle side for intercepting a projectile. The barrel has a first barrel section that adjoins the cartridge chamber and a second barrel section that adjoins the first barrel section. The first barrel section has a first cross section corresponding to a caliber of the projectile and the second barrel section has a second cross section that is larger than the first cross section.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
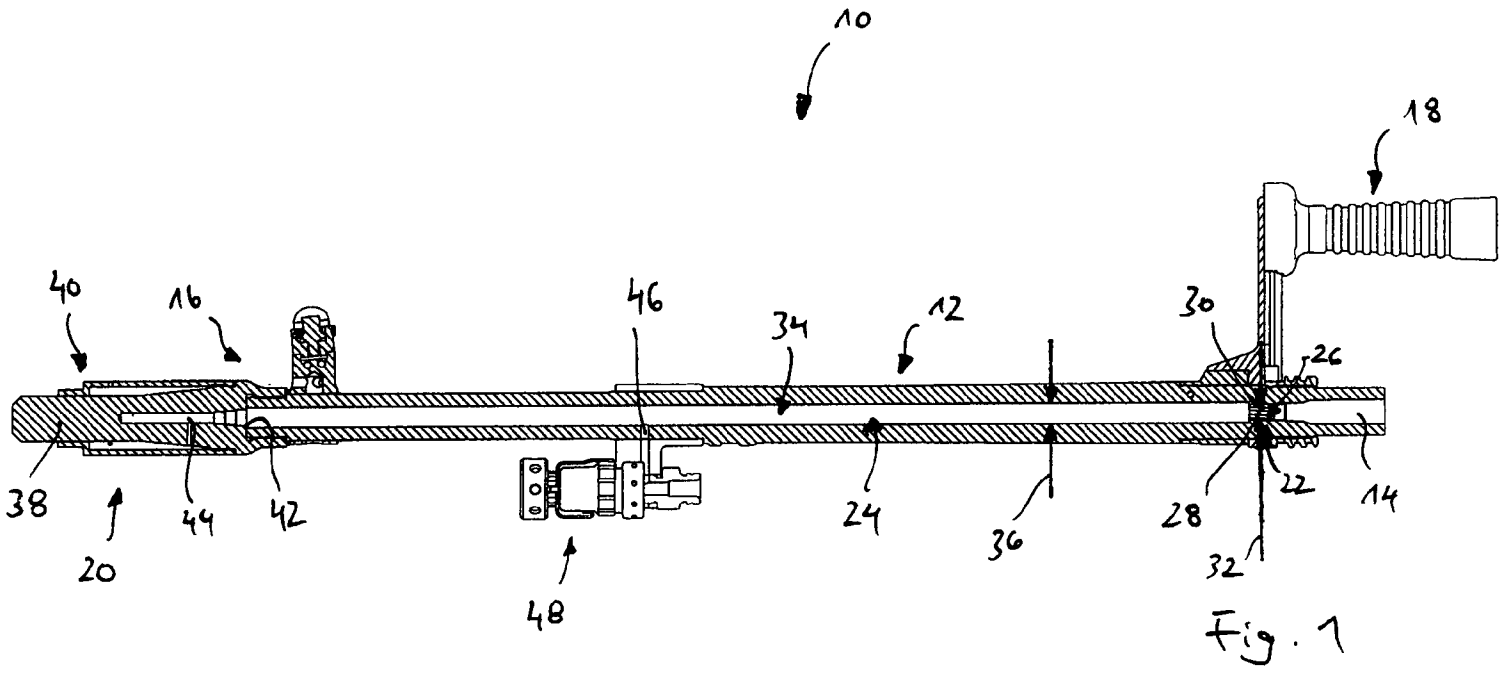
FIG. 1 a longitudinal sectional view of a first embodiment of a maneuver cartridge device with an empty cartridge chamber.

Especially in case of self-loading firearms with high firing rates of up to 1200 rounds per minute, it has been found that, if live ammunition is inadvertently fired, numerous shots might be fired before the user can react and stop the shooting.

With an eye towards the safety of users and their surroundings as well as with an eye towards preventing the self-loading firearm from being damaged or destroyed in the case of the inadvertent firing of live ammunition, an embodiment of the present invention provides a maneuver cartridge device that allows a self-loading firearm to be safely handled in case live rounds are inadvertently fired.

In an embodiment, the invention provides a maneuver cartridge device of the above-mentioned type, wherein the barrel has a first section that adjoins the cartridge chamber as well as a first cross section that is adapted to the caliber of the projectile, and wherein the barrel has a second section that adjoins the first barrel section as well as a second cross section that is larger than the first cross section.

In the maneuver cartridge device according to the invention, it is provided that, for maneuvers, the barrel of a self-loading firearm that is used with live ammunition is replaced with a "maneuver cartridge barrel". According to the invention, such a barrel has a first section that is "caliber-sized" (in other words, it allows the passage of a projectile of a live cartridge) and additionally, it has a second section that has a larger cross section than that of the first barrel section.

The first barrel section allows the passage of an unintentionally fired projectile so that it can travel from the cartridge chamber to the second barrel section. The enlargement of the cross section in the area of the second barrel section allows the propellant gases to overtake the projectile inside the second barrel section so that these gases are no longer available to the full extent to propel the projectile, as a result of which the projectile is not accelerated very much any more before reaching the intercepting device, thus striking with diminished impact. In this manner, as compared to a barrel that is continuously the size of the caliber, the kinetic energy of the projectile can be reduced by about 80% by the time it strikes the intercepting device.

The invention makes it possible to prevent the drawbacks that can be encountered with the constrictions that are found at the cartridge neck of a maneuver chamber and that are meant to prevent projectiles containing live ammunition from being loaded and fired. Due to the high kinetic locking energy of machine gun locking mechanisms, the risk exists that live cartridges that have been unintentionally loaded are nevertheless completely loaded when the projectiles are pressed into the cartridge neck and that the weapons loaded with these "press-loaded cartridges", along with the projectile that is supported towards the front, can nevertheless be fired, which could cause the cartridge to explode and damage the weapon as well as pose a considerable hazard to the user.

In contrast to this, within the scope of the invention, it is provided that a projectile leaves a cartridge chamber unhindered and, after passing through the first barrel section, it is only accelerated in the second barrel section to the smallest extent possible, and is finally intercepted by means of the intercepting device.

The second barrel section forms an expansion space for propellant gases. The cross section of the second barrel section is dimensioned so as to be larger than the caliber, in other words, it has a diameter that is preferably at least 1 mm, especially at least 2 mm, larger than the diameter of the first barrel section, which is just slightly larger than the rated caliber of the self-loading firearm, especially a machine gun.

For purposes of achieving the most effective possible reduction of the acceleration of the projectile, it is advantageous for the second barrel section to be longer than the first barrel section. In particular, it is preferable for the first barrel section to be several times shorter than the second barrel section.

In order for the second barrel section to be configured as long as possible and so as to create a correspondingly large expansion space for the propellant gases, it is preferable for the first barrel section to be as short as possible. However, it is preferable for the first barrel section to have a minimum length that is dimensioned in such a way that, when the maneuver cartridge has been inserted into the cartridge chamber, the tip of the maneuver cartridge does not extend into the second barrel section. This entails the advantage that, after the maneuver cartridge has been fired, its flanged cartridge tip, which expands radially outwards, can still be supported inside the first barrel section by the surface of the first barrel section. This prevents the cartridge tip from expanding into the second barrel section, something that might hinder the maneuver cartridge from being pulled out of the cartridge chamber.

The first barrel section can have a smooth surface or else a surface that is provided with grooves and lands.

It is especially preferable for the second barrel section to be hollow-cylindrical throughout, so that the propellant gases can flow along and past the entire circumference of a projectile that has been unintentionally fired.

A particularly preferred embodiment of the invention provides that the barrel has a gas outlet in the area of the second barrel section in order to drive a self-loading mechanism of a self-loading firearm, and it provides that the intercepting device has an intercepting element with an intercepting surface that is arranged adjacent to the gas outlet so that the gas outlet can be blocked by a projectile that has been intercepted by the intercepting device. In particular, the gas outlet can be blocked by means of just a single projectile and, in less preferred embodiments, by means of two or three projectiles at the maximum. Blocking the gas outlet has the advantage that the self-loading operation of a self-loading firearm is interrupted. This is due to the fact that projectile material, for instance, lead, contained in the projectile that has been unintentionally fired is deformed when it strikes the intercepting element and the deformed material then blocks the gas outlet.

Advantageously, the intercepting surface of the intercepting element is arranged so as to be flush or at least essentially flush with a delimitation of the gas outlet on the muzzle side in order to implement a particularly reliable blocking function.

In the simplest case, the intercepting surface is smooth and especially circular. In order to intercept a projectile "more gently", the intercepting surface can have a depression that serves to at least partially hold a projectile.

Preference is also given to arranging the intercepting element inside a part of the barrel located on the muzzle side (in contrast to the state of the art, in other words, not arranged outside of the barrel). The arrangement of the intercepting element inside the barrel makes it especially easy to position the intercepting surface described above next to a gas outlet in order to drive a self-loading mechanism.

In the simplest case, the intercepting element is attached to the barrel by means of a screwed connection, for instance, by means of a union nut. However, the intercepting element is or can be attached to the barrel by means of a maneuver-cartridge attachment that protrudes beyond the muzzle of the barrel or by means of a flash suppressor on the muzzle.

Another preferred embodiment provides that the intercepting device has a display element that can be moved relative to the barrel by means of a projectile, thus displaying that a projectile has been intercepted.

Preferably, the display element can be moved in the firing direction, so that the kinetic energy of a projectile can be utilized to move the display element. The display element entails the advantage that, in case of a malfunction, a user can immediately ascertain whether this malfunction can be traced back to the unintentional shooting of live ammunition while using the safety maneuver cartridge barrel.

In addition, when the causes of damage to the weapon or of a safety-relevant incident during shooting using maneuver ammunition are being investigated, such a display element constitutes a direct indicator of the unauthorized use of live ammunition with this safety maneuver cartridge barrel.

The invention also relates to a self-loading firearm, especially a machine gun, using a maneuver cartridge device of the type described above.

Figure 2:
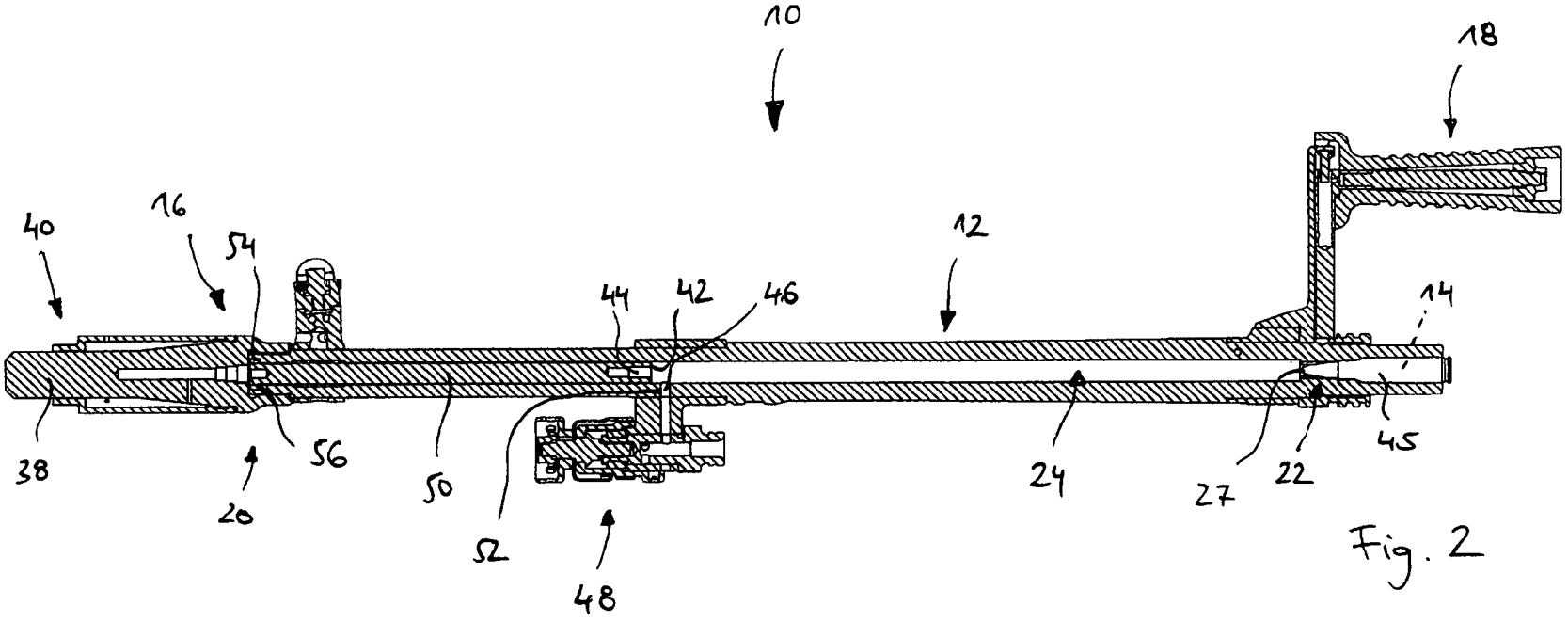
FIG. 2 a longitudinal sectional view of a second embodiment of a maneuver cartridge device when a maneuver cartridge is used.
Figure 3:
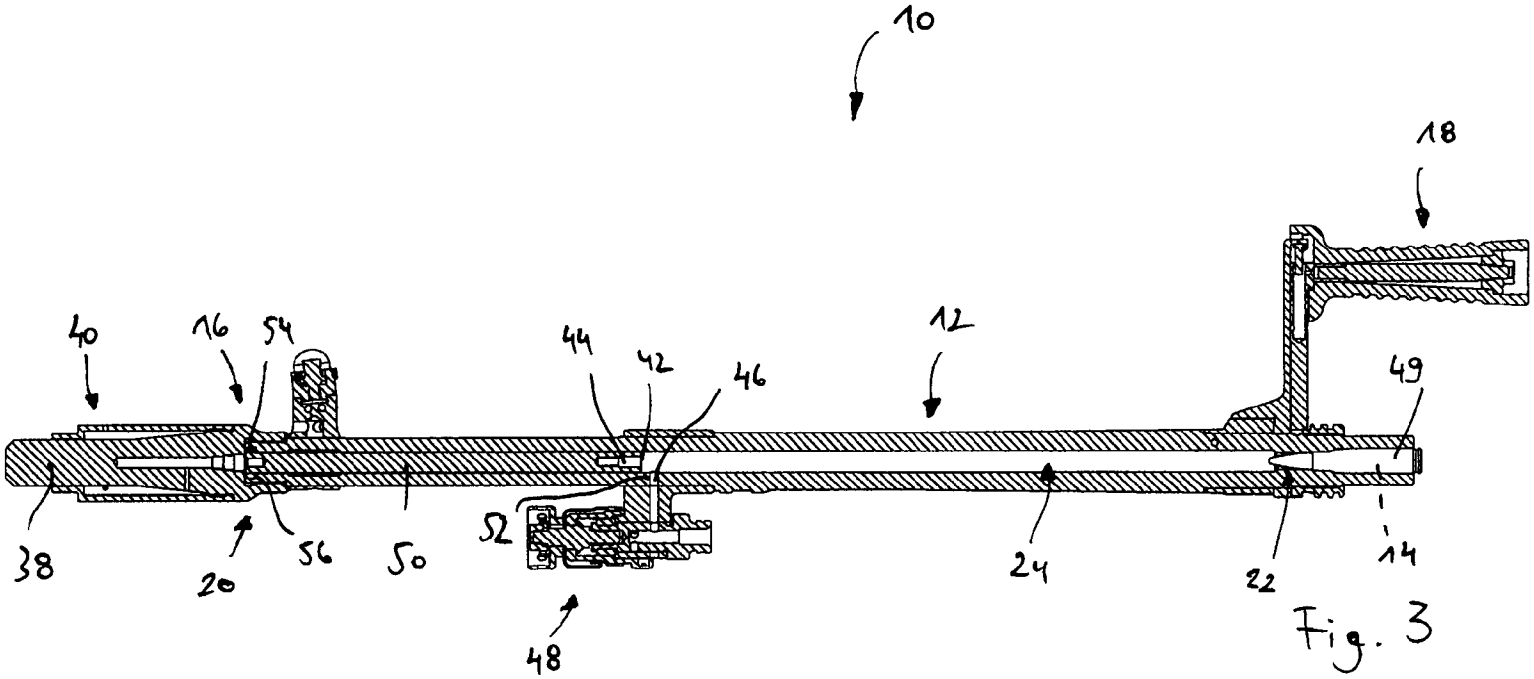
FIG. 3 a view corresponding to FIG. 2 when a live cartridge is used.

An embodiment of a maneuver cartridge device is shown in FIGS. 1 to 3 and it is designated there in its entirety by the reference numeral 10. The maneuver cartridge device 10 comprises a barrel 12 that extends from a cartridge chamber 14 to the muzzle side 16.

Approximately at the height of the cartridge chamber 14, there is a carrying handle 18 that is connected to the barrel 12. On the muzzle side, the maneuver cartridge device 10 has an intercepting device 20 for intercepting a projectile.

The barrel 12 has a first section 22 that adjoins the cartridge chamber 14 as well as a second section 24 that adjoins the first section 22. In particular, the barrel sections 22 and 24 are oriented concentrically with respect to each other.

The first barrel section 22 has a surface 26 with lands 28 and grooves 30. The surface 26 delimits a cross section 32 that is adapted to the rated caliber of a self-loading firearm for which the maneuver cartridge device 10 is intended. The first barrel section 22 with its surface 26 extends over a relatively short path. The first barrel section, however, is at least long enough that the tip 27 of a maneuver cartridge 45 (see FIG. 2) that has been inserted into the cartridge chamber 14 does not extend into the second barrel section 24.

The second barrel section 24 has a preferably continuous cylindrical and smooth surface 34 that delimits a second cross section 36. The second cross section 36 has a diameter that is preferably at least 1 mm, especially at least 2 mm, larger than the diameter of the first cross section 32.

Preferably, the second cross section 36 is larger along the entire course of the second barrel section 24 than the first cross section 32 of the first barrel section 22.

The second barrel section 24 is several times longer than the first barrel section 22.

The intercepting device 20 of the maneuver cartridge device 10 according to FIG. 1 has an intercepting element 38 that is integrated into a maneuver cartridge attachment 40. The maneuver cartridge attachment 40 is connected to the barrel 12 in the area of the muzzle 16.

The intercepting element 38 has an intercepting surface 42 that faces the cartridge chamber 14 and that is provided with a depression 44.

The maneuver cartridge device 10 is preferably color-coded. For maneuver operations, the maneuver cartridge device 10 is used instead of the original weapon barrel in a self-loading firearm. When maneuver cartridges are used, the propellant gases generated by a maneuver cartridge 45 are employed to discharge them at a gas outlet 46 of a gas-reduction means 48. The gas-reduction means 48 serves to drive a self-loading mechanism of the self-loading firearm, so that a series of maneuver cartridges can be automatically fired.

If the maneuver cartridge device 10 shown in FIG. 1 is unintentionally operated with a live cartridge (reference numeral 49, see FIG. 3), after a shot has been fired, the projectile/bullet of the live cartridge 49 passes through the caliber-sized first barrel section 22 and through the second, enlarged barrel section 24, ultimately dropping into the depression 44 of the intercepting element 38.

The intercepting device 20 of the maneuver cartridge device 10 according to FIGS. 2 and 3, in contrast to the intercepting device 20 shown in FIG. 1, is modified in such a way that an intercepting element 50 is provided which is arranged inside the barrel 12.

As a result, the intercepting surface 42 of the intercepting element 50 is shifted further towards the cartridge chamber 14. In this context, it is provided that the intercepting surface 42 is arranged directly adjacent to a delimitation 52 of the gas outlet 46 on the muzzle side. The shift of the intercepting surface 42 starting at the delimitation 52 in the direction of the muzzle 16 preferably ranges between approximately 0 mm and approximately 10 mm.

In order to ensure that a projectile is intercepted gently, preference is given to providing the intercepting surface 42 with a centrally arranged depression 44. For purposes of attaining the most reliable possible blocking of the gas outlet 46 by means of the projectile of a live cartridge 49, it is preferable for the intercepting surface 42 to be smooth and not to have any depression 44.

In order to affix the intercepting element 50 to the barrel 12, the intercepting element 50 has a radial widened segment 54 in the area of the muzzle 16, and this widened segment 54 cooperates with a ring-shaped holder 56 of the barrel 12. As seen in the firing direction towards the front, the intercepting element 50 is secured to the barrel 12 by means of the maneuver cartridge attachment 40.

During normal operation of the maneuver cartridge device 10 according to FIGS. 2 and 3 using maneuver cartridges, propellant gas is fed in via the gas outlet 46 of the gas-reduction means 48 and via a self-loading mechanism of the self-loading firearm that is familiar and thus not shown here. If a live cartridge 49 is unintentionally fired, the projectile passes through the barrel sections 22 and 24 and then, already at the height of the gas outlet 46 or shortly thereafter as seen in the firing direction, it strikes against the intercepting surface 42 of the intercepting device 50, as a result of which the projectile material is deformed and blocks the gas outlet 46. Consequently, the self-loading operation of the firearm is interrupted.

Figure 4:
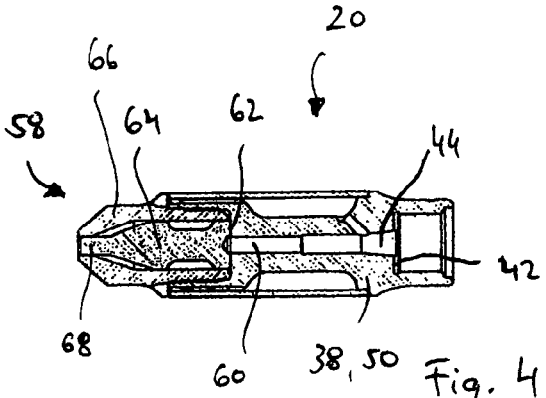
FIG. 4 a longitudinal sectional view of an embodiment of an intercepting device showing a display element in the initial state.
Figure 5:
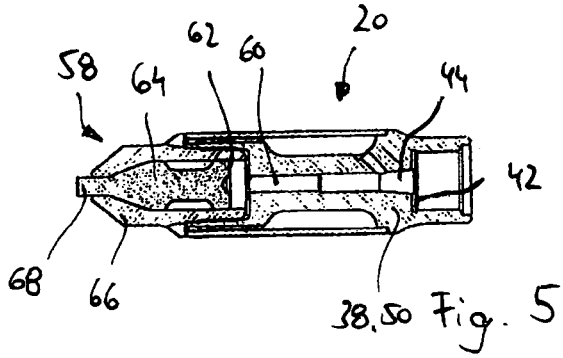
FIG. 5 a view corresponding to FIG. 4 showing the display element in the actuated state.

FIGS. 4 and 5 show another embodiment of an intercepting device 20 that comprises an intercepting element 38, 50. The intercepting element is provided with a depression 44 in the area of the intercepting surface 42.

Between the intercepting surface 42 and one end 58 of the intercepting device 20 facing away from the intercepting surface 42, there is an especially centrally arranged bore 60 that adjoins the depression 44 and opens up at the rear 62 of a display element 64. The display element 64 is mounted so that it can be moved in the firing direction inside a guide bushing 66. The display element 64 has a display section 68 that passes through the guide bushing 66.

Starting at the initial position of the display element 64 shown in FIG. 4, the impact of a projectile onto the intercepting surface 42 causes a deformation of the projectile, whereby at least parts of the deformed projectile act onto the rear 62 of the display element 64 via the depression 44 and the bore 60, so that the display element 64 is moved forward in the firing direction and the display section 68 is pushed out of the guide bushing 66 and is thus visible for a user from the side (see FIG. 5).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A maneuver cartridge device for use in a self-loading firearm, comprising a barrel extending from a cartridge chamber to a muzzle side and having an intercepting device arranged on the muzzle side, the barrel having a first barrel section that adjoins the cartridge chamber and a second barrel section that adjoins the first barrel section, the first barrel section having a first cross section corresponding to a rated caliber of the firearm for a projectile of a live cartridge and the second barrel section having a second cross section that is larger than the first cross section and is sized such that propellant gases overtake the projectile upon firing, the intercepting device being configured to stop and hold the projectile after firing the firearm.

2. The maneuver cartridge device according to claim 1, wherein the second barrel section is longer than the first barrel section.

3. The maneuver cartridge device according to claim 1, wherein the first barrel section has a minimum length that is dimensioned in such a way that a tip of a maneuver cartridge in an inserted state in the cartridge chamber does not extend into the second barrel section.

4. The maneuver cartridge device according to claim 1, wherein the second barrel section is hollow-cylindrical.

5. The maneuver cartridge device according to claim 1, wherein the barrel has a gas outlet in an area of the second barrel section useable to drive a self-loading mechanism of a self-loading firearm, and wherein the intercepting device has an intercepting element with an intercepting surface that is arranged adjacent to the gas outlet so that a projectile that has been intercepted by the intercepting device blocks the gas outlet.

6. The maneuver cartridge device according to claim 5, wherein the intercepting surface has a depression configured to at least partially hold a projectile.

7. The maneuver cartridge device according to claim 5, wherein the intercepting element is arranged inside a part of the barrel located on the muzzle side.

8. The maneuver cartridge device according to claim 5, wherein the intercepting element is attached to the barrel by means of a maneuver-cartridge attachment that protrudes beyond the muzzle of the barrel.

9. The maneuver cartridge device according to claim 1, wherein the intercepting device has a display element that is moveable relative to the barrel by means of a projectile so as to display that a projectile has been intercepted.

10. A self-loading firearm having a maneuver cartridge device comprising a barrel extending from a cartridge chamber to a muzzle side and having an intercepting device arranged on the muzzle side, the barrel having a first barrel section that adjoins the cartridge chamber and a second barrel section that adjoins the first barrel section, the first barrel section having a first cross section corresponding to a rated caliber of the firearm for a projectile of a live cartridge and the second barrel section having a second cross section that is larger than the first cross section and is sized such that propellant gases overtake the projectile upon firing, the intercepting device being configured to stop and hold the projectile after firing the firearm.

11. The self-loading firearm according to claim 10, wherein the self-loading firearm is a machine gun.

* * * * *